US007617749B2

(12) United States Patent
Kelland

(10) Patent No.: US 7,617,749 B2
(45) Date of Patent: Nov. 17, 2009

(54) SIDING HAMMER AND ATTACHMENTS FOR CONVERTING A HAMMER TO A SIDING HAMMER

(76) Inventor: Robert E. Kelland, 109 McNiven Place, St. John's, NL (CA) A1A 4X1

( * ) Notice: Subject to any disclaimer, the term of this patent is extended or adjusted under 35 U.S.C. 154(b) by 0 days.

(21) Appl. No.: 11/745,624

(22) Filed: May 8, 2007

(65) Prior Publication Data

US 2008/0276759 A1 Nov. 13, 2008

(51) Int. Cl.
*B25D 1/14* (2006.01)
*B25D 1/10* (2006.01)
*B25C 3/00* (2006.01)

(52) U.S. Cl. ..... 81/26; 81/23

(58) Field of Classification Search ..... 81/20, 81/21, 25, 26, 44, 490; 7/143; D8/75, 77, D8/78, 81

See application file for complete search history.

(56) References Cited

U.S. PATENT DOCUMENTS

| | | | | | |
|---|---|---|---|---|---|
| 115,008 | A * | 5/1871 | Young | 81/23 |
| 1,663,886 | A * | 3/1928 | Lutch | 81/21 |
| 1,712,343 | A * | 5/1929 | Gerhardt | 81/490 |
| 1,718,161 | A * | 6/1929 | Lutch | 81/21 |
| 1,718,733 | A * | 6/1929 | Dominick | 30/308.1 |
| 3,164,178 | A * | 1/1965 | Belgard | 81/21 |
| 3,620,159 | A * | 11/1971 | Gould | 101/28 |
| D267,469 | S * | 1/1983 | Crowder | D8/75 |
| 4,367,778 | A * | 1/1983 | Bradbury | 81/23 |
| 4,437,602 | A | 3/1984 | Kaczmarek | |
| D308,007 | S * | 5/1990 | Ferguson et al. | D8/75 |
| D350,889 | S * | 9/1994 | Frierman | D8/78 |
| D353,758 | S * | 12/1994 | Frykman | D8/78 |
| 6,564,681 | B2 * | 5/2003 | Coulter | 81/487 |
| 6,824,036 | B2 | 11/2004 | Walter | |
| 7,249,541 | B1 * | 7/2007 | Osborne | 81/180.1 |
| 2007/0051208 | A1 * | 3/2007 | Stephens | 81/44 |

FOREIGN PATENT DOCUMENTS

DE 10118548 A1 2/2001

* cited by examiner

*Primary Examiner*—David B Thomas

(57) ABSTRACT

A siding hammer having a depth control face spaced in front of a striking face of a hammer head of the hammer. The depth control face strikes a substrate into which a fastener is being driven when the fastener has been driven to a predetermined depth of penetration in the substrate to inhibit the fastener from being driven further into the substrate. In certain embodiments, the depth control face is removable to permit the hammer to be used without depth of penetration control. In certain embodiments, the depth control face is adjustable to adjustably control fastener depth penetration. Attachments are also provided for temporarily converting a hammer into a siding hammer.

11 Claims, 7 Drawing Sheets

SIDING HAMMER AND ATTACHMENTS FOR CONVERTING A HAMMER TO A SIDING HAMMER

FIELD OF THE INVENTION

This invention relates in general to hammers and, in particular, to a siding hammer for controlling nail depth penetration to facilitate proper siding installation, especially vinyl or aluminum siding installation.

BACKGROUND OF THE INVENTION

Vinyl and aluminum sidings are among the most popular residential building finishes in use today. They are inexpensive to manufacture, relatively straightforward to install and provide a durable, attractive finish. However, properly fastening vinyl or aluminum siding to a structure is challenging for even an experienced craftsmen. As well understood in the art, vinyl and aluminum sidings expand and contract with changes in temperature. Consequently, the head of siding fasteners must not be driven tightly against the siding nail hem or expansion and contraction will eventually cause unsightly buckles and, in the case of vinyl siding, may crack the material.

As understood by those skilled in the art, it is difficult for even the skilled professional to control nail depth penetration to ensure that an inner side of the head of every fastener used to install vinyl or aluminum siding is spaced (1/32" is generally recommended) from the siding nail hem. Expensive mechanical fastener drivers have been developed to facilitate proper installation, but even mechanical fastener drivers have their disadvantages. For example, they are generally bulky and do not usually provide a clear field of view of where the fastener will be driven, so it can be difficult to ensure that each fastener is driven in a nail slot in the nail hem. Missing the nail slot is even more undesirable than driving the fastener tight against the nail hem. Second, mechanical fastener drivers cannot be used in certain locations, such as tight inside corners, close to eaves or overhangs, etc.

There therefore exists the need for a siding hammer that facilitates proper installation of siding materials, in particular vinyl and aluminum siding and trim components normally used in association with the siding.

SUMMARY OF THE INVENTION

It is therefore an object of the invention to provide a siding hammer and attachments for converting a hammer to a siding hammer when required.

The invention therefore provides a siding hammer having a hammer head with a striking face for driving a fastener and a depth control face offset in front of the striking face that impacts a substrate into which the fastener is driven after a predetermined penetration of the fastener into the substrate, the depth control face inhibiting further penetration of the fastener into the substrate after the depth control face impacts the substrate.

The invention further provides an attachment for a head of a hammer to convert the hammer into a siding hammer, the attachment providing a depth control face offset in front of a striking face of the hammer, the depth control face impacting a substrate into which the fastener is driven after a predetermined penetration of the fastener into the substrate, the depth control face inhibiting further penetration of the fastener into the substrate after the depth control face impacts the substrate.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a siding hammer having a hammer head with a striking face for driving a fastener and a rigid depth control face offset in front of the striking face for impacting a substrate into which the fastener is driven after a predetermined penetration of the fastener into the substrate. The rigid depth control face inhibits further penetration of the fastener into the substrate after it impacts the substrate. The invention also provides attachments for converting a hammer into a siding hammer. The attachments are removably connected to a head of the hammer.

Figure 1:
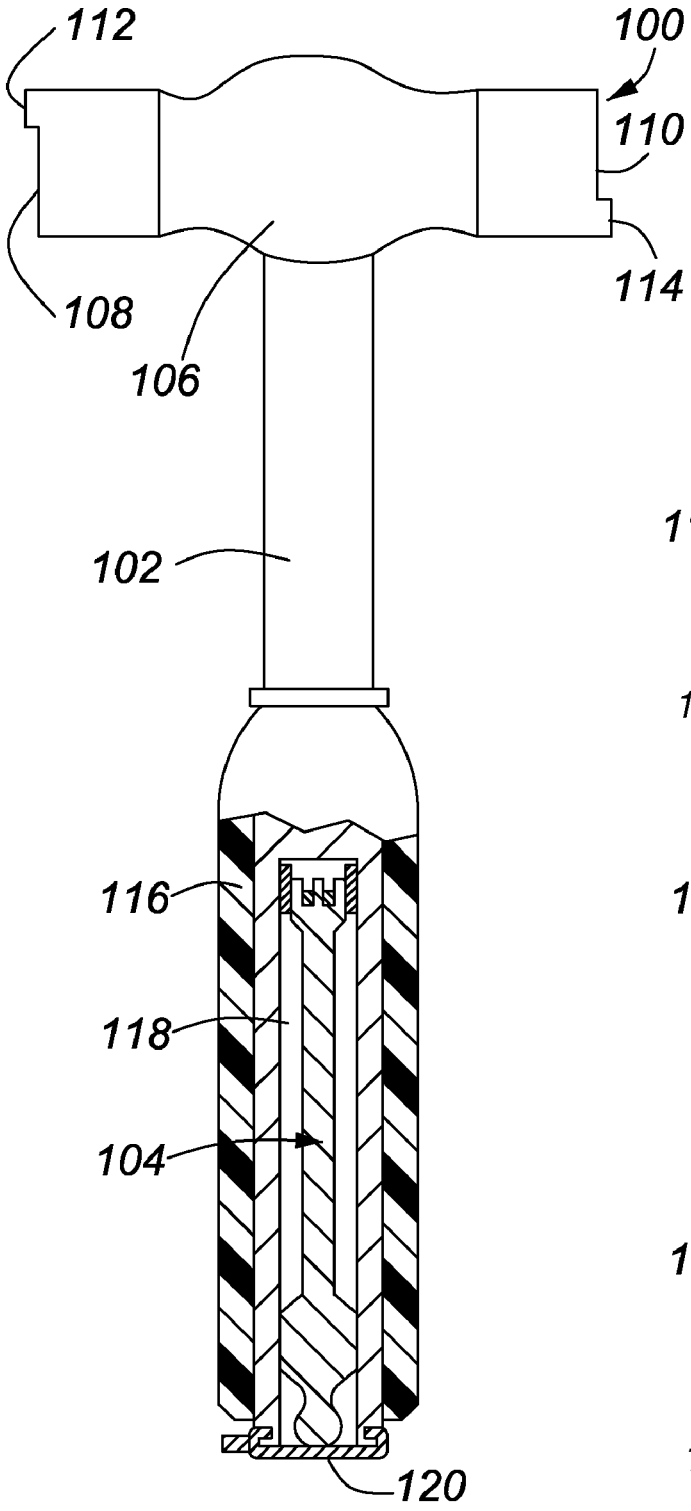
FIG. 1 is a side elevational view of one embodiment of a siding hammer in accordance with the invention, showing a handle portion of the siding hammer partially cut away to show a hard-to-reach nail driving tool supplied with one embodiment of the siding hammer.

FIG. 1 is a side elevational view of one embodiment of a siding hammer 100 in accordance with the invention, showing a handle portion 102 of the siding hammer partially cut away to reveal a hard-to-reach nail driving tool 104 supplied with one embodiment of the siding hammer 100. The siding hammer 100 has a hammer head 106 with a first striking face 108 and a second striking face 110. A depth control face 112 is offset in front of the first striking face 108. The depth control face 112 impacts a substrate into which a fastener is driven after a predetermined penetration of the fastener into the substrate, as will be explained below with reference to FIGS. 4*a*, 4*b* and 5. The depth control face inhibits further penetration of the fastener into the substrate after the depth control face impacts the substrate. A second depth control face 114 is offset in front of the second striking face 110, and serves the same purpose. The first striking face 108 is used to drive nails when the hammer is swung with the head 106 above the handle 102, as will be explained below with reference to FIGS. 4*a* and 4*b*. The second striking face 110 is used to drive nails when the hammer is swung with the head 106 below the handle 102, as will be explained below with reference to FIG. 5.

An offset of the depth control faces 112, 114 from the respective striking faces 108, 110 in one embodiment is equal to a thickness of a nailing hem of a siding to be installed, and a thickness of the nail heads used to install the siding, plus about 1/32". Experiments have shown that 3/16"-1/4" works well for most siding installation applications.

In this embodiment, the handle 102 of the siding hammer 100 is constructed of fiberglass or steel and includes a grip 116 of synthetic rubber, or the like. The handle 102 includes a cavity 118 that receives the hard-to-reach nail driving tool 104. In this embodiment, the nail driving tool 104 is held in the cavity 118 by a removable cap 120, preferably made of a durable plastic.

Figure 2A:
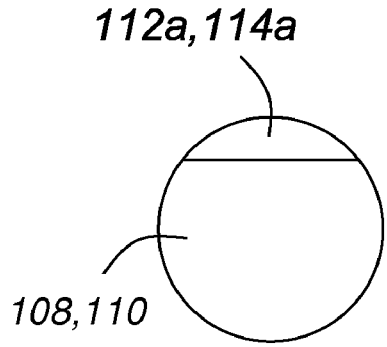
FIGS. 2*a*-2*d* are front end elevational views of a striking face of the siding hammer shown in FIG. 1, illustrating various embodiments of a depth control face of the siding hammer.
Figure 2B:
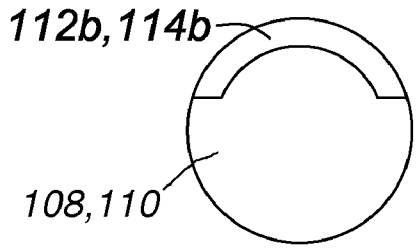
Figure 2C:
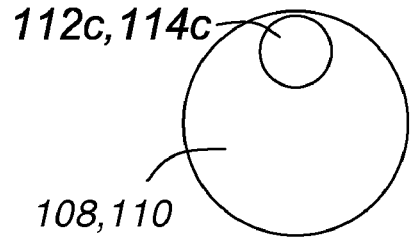
Figure 2D:
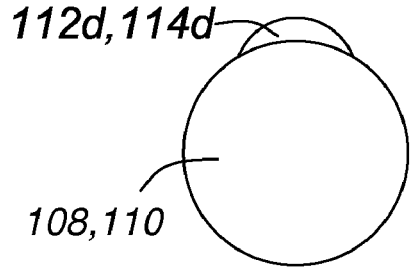

FIGS. 2*a*-2*d* are front end elevational views of different embodiments of the depth control faces 112, 114 of the siding hammer 100 shown in FIG. 1. The depth control face 112*a*, 114*a* is a circular segment affixed to the top or bottom side of the striking face 108, 110. The depth control face 112*a*, 114*a* may be formed by casting, forging, machining away a portion of the striking face 108, 110, or by bonding (soldering, welding or gluing) a piece of steel to the striking face 108, 110. The depth control face 112*b*, 114*b* shown in FIG. 2*b* is U-shaped and may be formed using either a casting, forging, welding or machining process, or by bonding a piece of steel to the striking face, as described above. The depth control face 112*c*, 114*c* shown in FIG. 2*c* is circular or oval and may be formed using either the casting, forging, machining, welding or bonding process described above. The depth control face 112*d*, 114*d* shown in FIG. 2*d* is semicircular in the embodiment illustrated but may be square, rectangular, triangular, circular, oval or any other shape desired. The depth control face 112*d*, 114*d* is formed by a casting, forging, welding or bonding process described above.

Figure 3A:
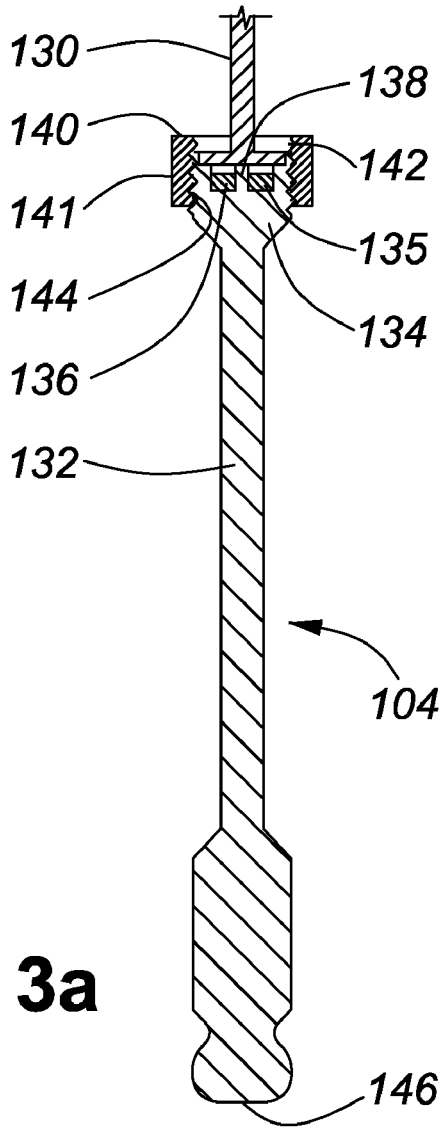
FIG. 3*a* is schematic cross-sectional view of the hard-to-reach nail driving tool shown in FIG. 1.

FIG. 3*a* is schematic cross-sectional view of the hard-to-reach nail driving tool 104 shown in FIG. 1. The nail driving tool 104 includes a shaft 132 that supports a nail driving head 134. The nail driving head 134 has a doughnut-shaped cavity 135 in which a doughnut-shaped rare earth magnet 136 is secured, for example by gluing. The rare earth magnet 136 is brittle and cannot withstand the impact required to drive nails 130. Consequently, a drive pin 138 extends through a center of the doughnut-shaped magnet 136. The drive pin 138 aligns with a shaft of the nail 130 to drive the nail 130 into a substrate (not shown). In this embodiment the nail driving tool 104 has an adjustable depth control face 140 formed on the outer end of a circular sleeve 141 having a box thread 142 that engages a pin thread 144 on an outer periphery of the nail driving head 134. This permits a penetration of the nail 130 to be selectively controlled by the adjusting the offset of the depth control face 140. A flat end 146 of the shaft 132 is struck by a striking face 108, 110 of the siding hammer 100 to drive nails in hard-to-reach places, or in overhangs, eaves, or the like.

Figure 3B:
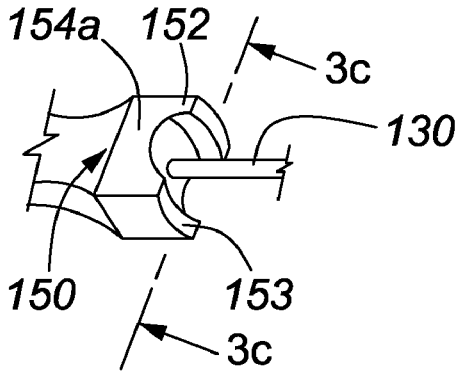
FIG. 3*b* is schematic perspective view of another embodiment of a head of the hard-to-reach nail driving tool shown in FIG. 3*a;*

FIG. 3*b* is schematic perspective view of another embodiment of a nail driving head 150 of the hard-to-reach nail driving tool 104 shown in FIG. 3*a*. The nail driving head 150 has opposed flat side surfaces, only one (154*a*) of the flat side surfaces is shown (see FIG. 3*b*), but the opposed flat side surfaces are identical. The flat side surfaces reduce a width of the nail driving head in order to permit it to be used for driving nails in confined spaces, such as the nailing hem of a siding with a roll-over top edge which is described below with reference to FIG. 4*b*.

Figure 3C:
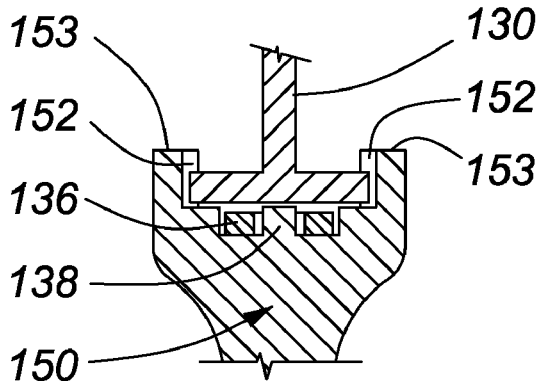
FIG. 3*c* is schematic cross-sectional view of the hard-to-reach nail driving tool shown in FIG. 3*b;*

FIG. 3*c* is a schematic cross-sectional view taken along lines 3*c*-3*c* of FIG. 3*b* of the nail driving head 150. In this embodiment, the nail driving head 150 has a two-part fixed offset 152 with a fixed depth control face 153. The opposed flat side faces (154*a* is shown) seen in FIG. 3*b*, permit this embodiment of the nail driving tool to be used in tight spaces, as explained above. As can be seen, a top of the donut-shaped rare earth magnet 136 is recessed below a top of the nail driving pin 138 so that the rare earth magnet 136 is protected from impact.

Figure 4A:
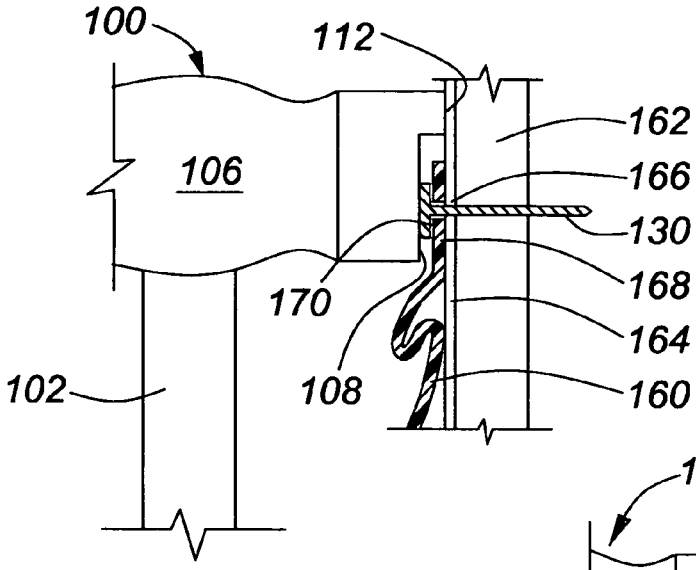
FIG. 4*a* is a schematic diagram illustrating the siding hammer shown in FIG. 1 in use when nailing with the hammer head above the hammer handle.

FIG. 4*a* is a schematic diagram illustrating the siding hammer shown in FIG. 1 in use when nailing in any location where the hammer head 106 is swung above the hammer handle 102, generally at or above waist level. The siding hammer 100 is being used to install a siding 160 over a substrate 162, for example plywood or oriented-strand board (OSB). The substrate 162 is covered with a building wrap 164 well known in the art. The siding hammer 100 drives a nail 130 through a nail slot 166 of a nail apron 168 of the siding 160. The siding 160 is, for example, vinyl or aluminum siding, both of which are well known in the art. The striking face 108 of the siding hammer 100 is used to drive the nail 130 through the nail slot 166, the building wrap 164 and the substrate 162. After the nail has been driven to a predetermined penetration depth, the depth control face 112 strikes the building wrap/substrate 164, 162 to inhibit further penetration of the nail 130. Ideally, an inner side 170 of a head of the nail 130 is spaced about 1/32" from an outer surface of the nail hem 168. This permits the siding 160 to move as it expands and contracts in response to changes in temperature, thus eliminating unsightly bulges, ripples or cracks in the installed siding.

Figure 4B:
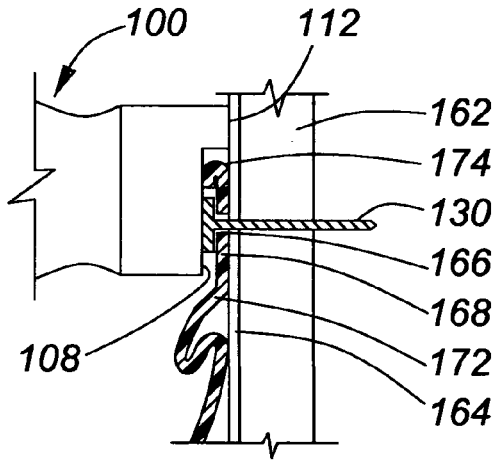
FIG. 4*b* is a schematic diagram illustrating the siding hammer shown in FIG. 4*a* in use for nailing siding with a roll-over edge along a top edge of a nailing hem of the siding.

FIG. 4*b* is a schematic diagram illustrating the siding hammer 100 shown in FIG. 4*a* in use for nailing a siding 172 with a roll-over edge 174 along a top edge of the nailing hem 168 of the siding 172. As is understood by those skilled in the art, certain brands of both vinyl and aluminum siding are now sold with a roll-over top edge along the nailing hem 168 to lend rigidity to the installed siding. The siding hammer 100 in accordance with the invention has the advantage of inhibiting crushing blows to the roll-over edge 174, as well as controlling penetration depth of the nails 130.

Figure 5:
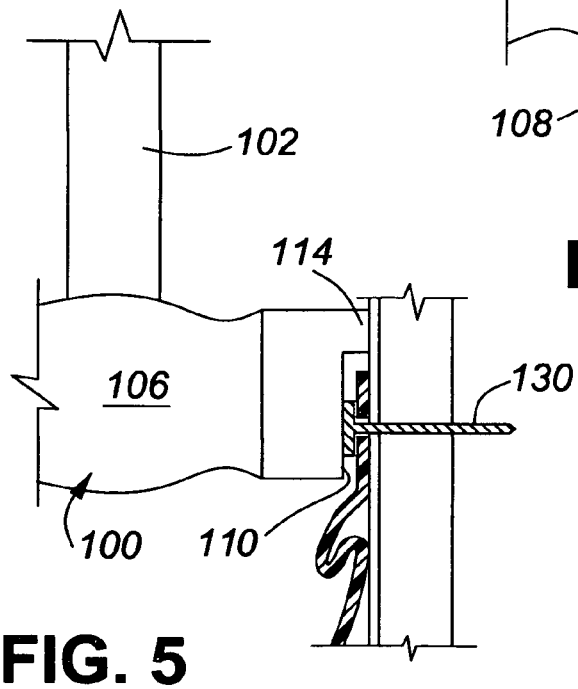
FIG. 5 is a schematic diagram illustrating the siding hammer shown in FIG. 1 in use when nailing with the hammer head below the hammer handle.

FIG. 5 is a schematic diagram illustrating the siding hammer 100 shown in FIG. 1 in the use when nailing in any location where the hammer head 106 is swung below the hammer handle 102, generally below waist level. The principles described above with reference to FIG. 4*a* apply.

Figure 6A:
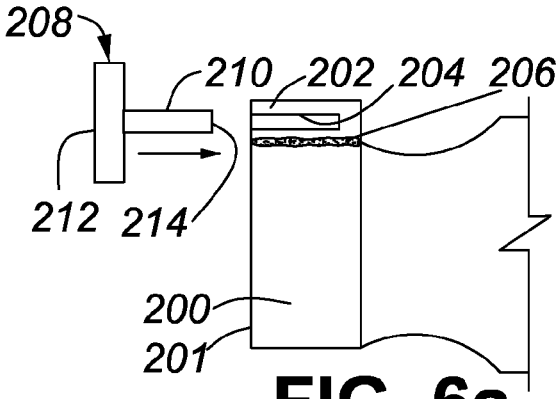
FIG. 6*a* is a side elevational view of another embodiment of a siding hammer head in accordance with the invention, showing a plastic insert for providing a depth control face offset in front of a striking face of the hammer head.
Figure 6B:
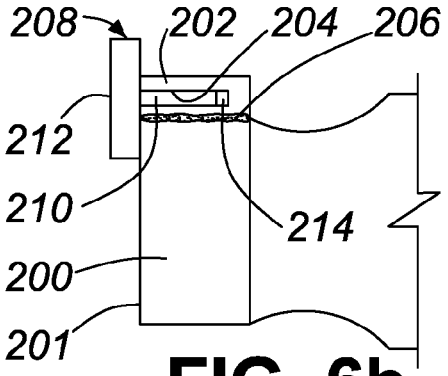
FIG. 6*b* is a side elevational view of the siding hammer head shown in FIG. 6*a*, with the plastic insert installed.

FIG. 6*a* is a side elevational view of another embodiment of a siding hammer head 200 in accordance with the invention, showing a plastic insert 208 for providing a depth control face 212 offset from a striking face 201 of the hammer head 200. A hollow steel cylinder 202 is integrally cast with the hammer head 200 or welded 206 to a center of a top edge of the hammer head 200. A slot 204 cut in a side of the hollow cylinder 202 communicates with an interior of the hollow cylinder 202. The plastic insert 208 includes a pin end 210. The pin end has an outer diameter small enough to permit the pin to be driven into the hollow cylinder 202, but large enough to ensure that it is frictionally retained in the hollow cylinder after it has been driven into place, as shown in FIG. 6*b*. The plastic insert is generally T-shaped and provides a depth control face 212 spaced in front of a striking face 201 of the hammer head 200.

FIG. 6*b* is a side elevational view of the siding hammer 200 shown in FIG. 6*a*, with the plastic insert 208 inserted. As can be seen, a rear end 214 of the pin end 210 is accessible through the slot 204. This permits an awl, for example, to be used to pry or drive the plastic insert 208 from the hollow cylinder 202. Consequently, the plastic insert 208 can be removed to permit the hammer to be used without the depth control face 212, or to replace the plastic insert 208 when it becomes worn from use.

Figure 7A:
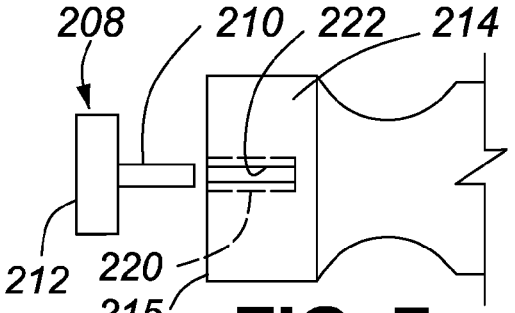
FIG. 7*a* is a top plan view of another embodiment of a siding hammer head in accordance with the invention, showing the plastic insert for providing a depth control face offset in front of a striking face of the hammer head.
Figure 7B:
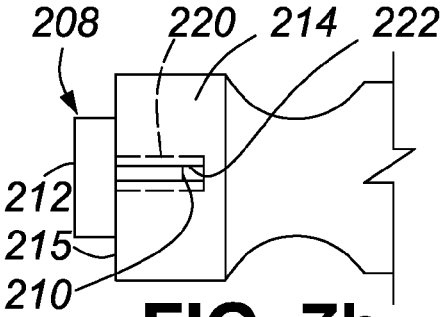
FIG. 7*b* is a top plan view of the siding hammer shown in FIG. 7*a*, with the plastic insert installed.

FIG. 7*a* is a top plan view of another embodiment of a siding hammer head 214 in accordance with the invention, showing the plastic insert 208 for providing the depth control face 212 in front of a striking face 215 of the hammer. The plastic insert works in the same way as a plastic insert described above with reference to FIGS. 6*a* and 6*b*, except that a bore at 220 is cast or machined into the striking face 215 of the hammer head 214. A slot 222 communicates with the bore 220 to permit the plastic insert 208 to be pried or driven out of the bore 220. As can be seen, the plastic insert 208 has a depth control face 212 that is spaced farther in front of the striking face 215 of the hammer head 214 than the plastic insert 208 shown in FIGS. 6*a* and 6*b*. Thus, the plastic inserts 208 can be manufactured for different applications and are readily interchanged as required. FIG. 7*b* is a top plan view of the siding hammer shown in FIG. 7*a*, with the plastic insert 208 installed.

Figure 8:
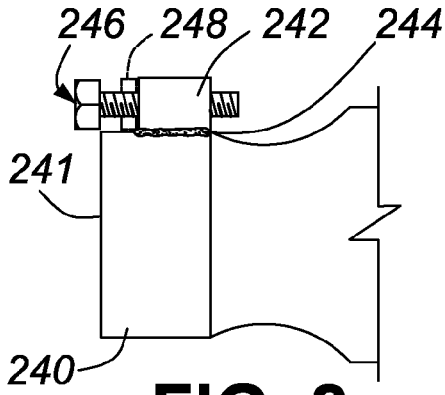
FIG. 8 is a side elevational view of another embodiment of a siding hammer head in accordance with the invention.

FIG. 8 is a side elevational view of another embodiment of a siding hammer head 240 in accordance with the invention. The hammer head 240 has a striking face 241. A threaded cylinder 242 is integrally formed or welded 244 to a top of the hammer head 240. The depth control face is provided by hex bolt 246 received in the threaded cylinder 242. The hex bolt 246 can be screwed in to a retracted position shown at 248 in order to permit the hammer head 240 to be used without the depth control face.

Figure 9:
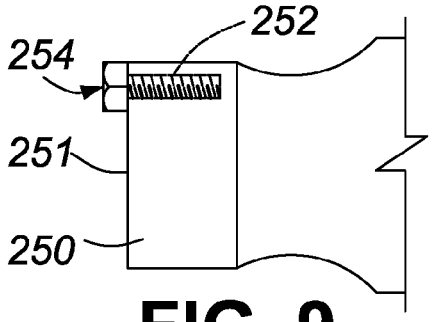
FIG. 9 is a side elevational view of yet another embodiment of a siding hammer head in accordance with the invention.

FIG. 9 is a side elevational view of yet another embodiment of a siding hammer head 250 in accordance with the invention. The siding hammer head 250 has a striking face 251 which includes a threaded bore 252 that receives a hex bolt 254 to provide the depth control face. The hex bolt 254 may be removed to permit the siding hammer head 250 to be used without the depth control face.

Figure 10:
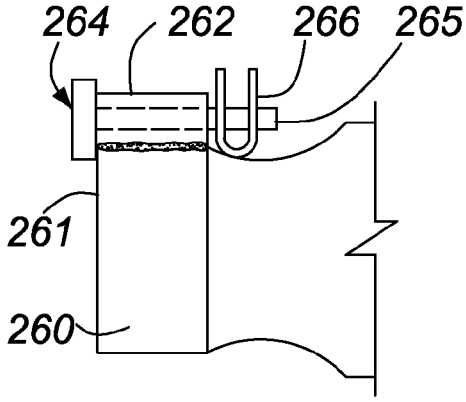
FIG. 10 is a side elevational view of yet a further embodiment of a siding hammer head in accordance with the invention.

FIG. 10 is a side elevational view of yet a further embodiment of a siding hammer head 260 in accordance with the invention. The siding hammer head 260 includes a striking face 261. A hollow cylinder 262 is integrally formed by casting or is welded to a top of the siding hammer head 260. A T-shaped insert 264 having a pin end 265 that is inserted through the hollow cylinder 262 to retain the T-shaped insert in the hollow cylinder 262. A spring clip 266, well known in the art, retains the T-shaped insert 264 in the hollow cylinder 262. A passage through the hollow cylinder 262 (not shown) may be triangular, square or hexagonal, for example, to prevent rotation of the T-shaped insert 264. The T-shaped insert 264 may be made of steel, plastic, or any other suitable material.

Figure 11:
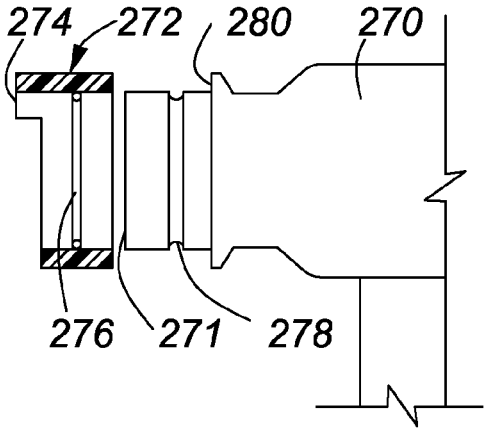
FIG. 11 is a side elevational view of another embodiment of a siding hammer head in accordance with the invention, showing in cross section a plastic attachment for converting the hammer from normal use to siding installation use.
Figure 12:
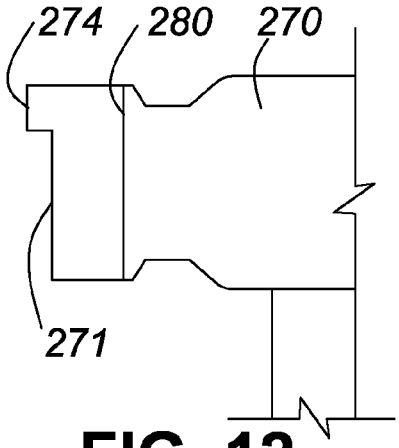
FIG. 12 is a side elevational view of the embodiment shown in FIG. 11 with the plastic attachment installed.

FIG. 11 is a side elevational view of another embodiment of a siding hammer head 270 in accordance with the invention. The siding hammer head 270 has a striking face 271. A plastic attachment 272 shown in cross-section is provided for converting the siding hammer from normal use to siding installation use. The plastic attachment 272 is ring-shaped and includes a forward extension that provides the depth control face 274. A ridge 276 molded on an inside of the ring-shaped plastic attachment 272 engages a groove 278 in the siding hammer head 270 to retain the plastic attachment 272 on the siding hammer head 270 when it is driven into place. A retainer ridge 280 formed on the siding hammer head 270 abuts a rear edge of the plastic attachment 272 to prevent the ridge 276 from being dislodged from the groove 278 when the depth control face 274 strikes a substrate into which a nail is being driven. When the plastic attachment 272 becomes worn, or it is desired to use the siding hammer head 270 for normal use, the plastic attachment 272 is pried off or cut off using, for example, a utility knife or the like. FIG. 12 is a side elevational view of the siding hammer head 270 shown in FIG. 11 with the plastic attachment 272 installed.

Figure 13:
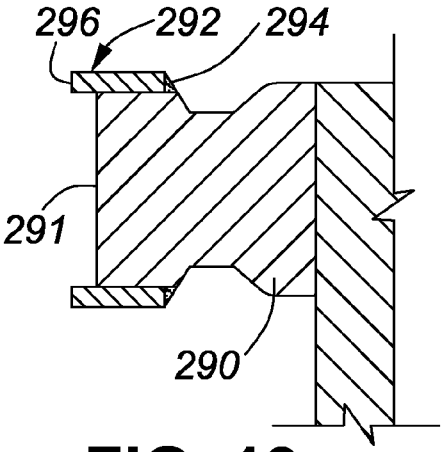
FIG. 13 is a schematic cross-sectional view of another embodiment of a siding hammer head in accordance with the invention.

FIG. 13 is a schematic cross-sectional view of another embodiment of a siding hammer head 290 in accordance with the invention. The hammer head 290 has a striking face 291. A cylindrical collar at 292 is welded 294 to the hammer head 290 to provide a depth control face 296 that completely surrounds the striking face 291.

Figure 14:
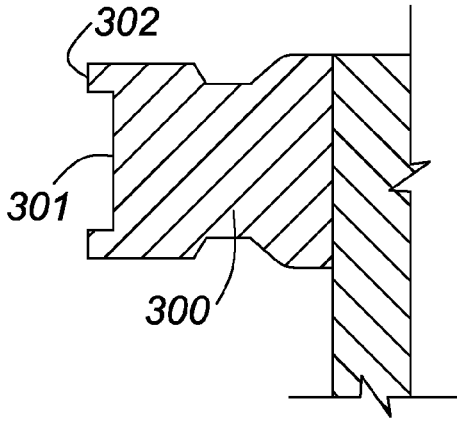
FIG. 14 is a schematic cross-sectional view of yet another embodiment of a siding hammer head in accordance with the invention.

FIG. 14 is a schematic cross-sectional view of yet another embodiment of a siding hammer head 300 in accordance with the invention. The siding hammer head 300 has a striking face 301. A depth control face 302 is integrally cast, forged, welded or machined around the striking face 301.

Figure 15:
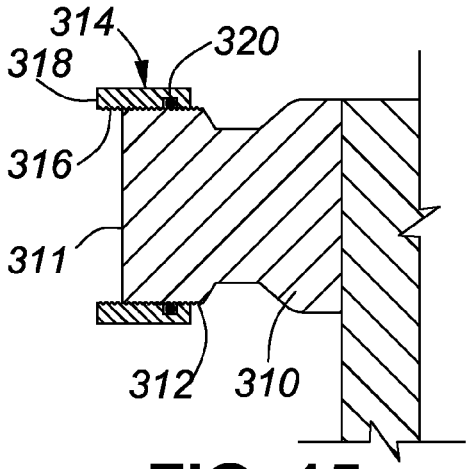
FIG. 15 is a schematic cross-sectional view of another embodiment of a siding hammer head in accordance with the invention having an adjustable ring for providing an adjustable depth control face.

FIG. 15 is a schematic cross-sectional view of another embodiment of a siding hammer head 310 in accordance with the invention. The siding hammer head 310 has a striking face 311. A pin thread 312 is machined on the hammer head 310 behind the striking face 311. A steel ring 314 with a box thread 316 engages the pin thread 312 to provide a depth control face 318 that is adjustable with respect to the striking face 311. A thermoplastic insert 320 in the box thread 316 inhibits rotation of the steel ring 314 when the hammer head 310 is in use.

Figure 16:
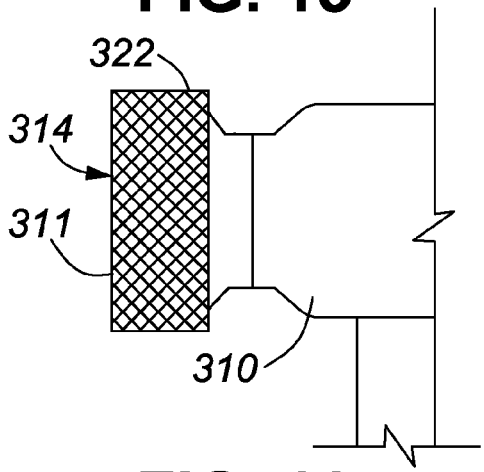
FIG. 16 is a side elevational view of the embodiment shown in FIG. 15 with the adjustable ring turned completely in for normal hammer use.

FIG. 16 is a side elevational view of the siding hammer head 310 shown in FIG. 15 with the depth-control ring turned completely in for normal hammer use. The steel ring 314 preferably has a knurled surface 322 to facilitate manual adjustment of the steel ring 314.

Figure 17:
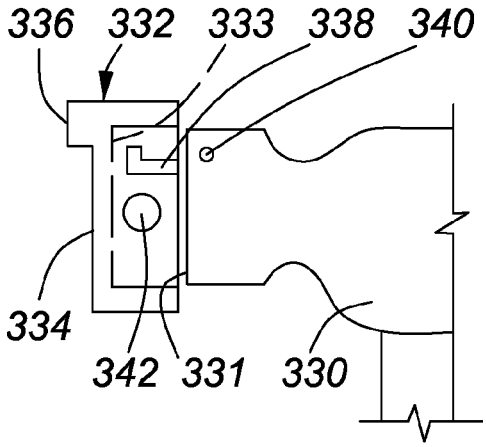
FIG. 17 is a side elevational view of yet a further embodiment of a siding hammer head in accordance with the invention, showing a removable attachment in front of the striking face of the hammer.
Figure 18:
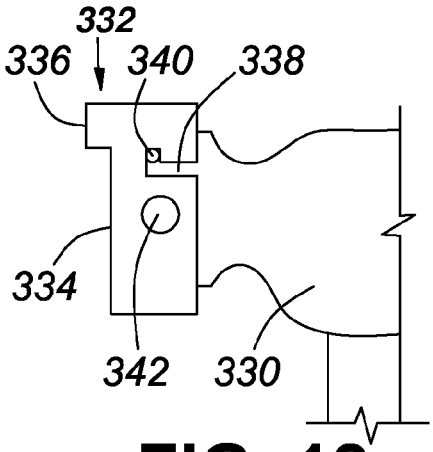
FIG. 18 is a side elevational view of the embodiment shown in FIG. 17 with the removable attachment installed for siding installation use.

FIG. 17 is a side elevational view of yet a further embodiment of a siding hammer head 330 in accordance with the invention. The siding hammer head 330 has a striking face 331. A removable attachment 332 is shown spaced in front of the striking face 331 of the siding hammer head 330. The removable attachment 332 is circular and includes a cavity 333 for receiving the front end of the siding hammer head 330. The removable attachment 332 has a striking face 334 and a depth control face 336. An L-shaped slot 338 cooperates with a pin 340 on a side of the siding hammer head 330 to lock the removable attachment 332 to the siding hammer head 330. A rotation inhibitor 342, schematically shown, inhibits rotation of the removable attachment 332 when it is locked in place by the locking pin 340. The rotation inhibitor 342 may be, for example, one or more rare earth magnets. The rotation inhibitor 342 may also be, for example, one or more thermoplastic buttons that frictionally engage the siding hammer head 330 when the removable attachment 332 is locked in place by the locking pin 340. The removable attachment 332 is removed to use the siding hammer head 330 for normal use. FIG. 18 is a side elevational view of the siding hammer head 330 shown in FIG. 17 with the removable attachment 332 locked to the siding hammer head 330.

Figure 19:
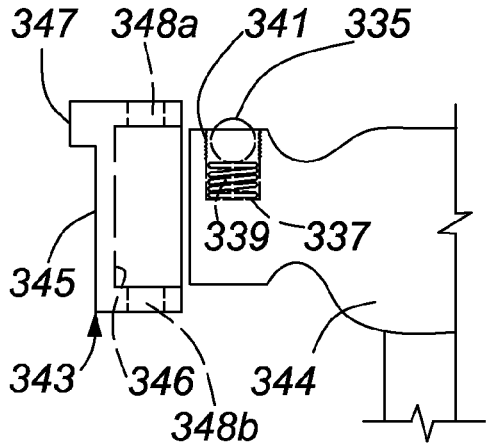
FIG. 19 is a side elevational view of yet another embodiment of a siding hammer head in accordance with the invention, showing a removable attachment in front of the striking face of the hammer.

FIG. 19 is a side elevational view of yet another embodiment of a siding hammer head 344 in accordance with the invention, showing a removable attachment 343 in front of a striking face of the siding hammer head 344. In this embodiment, a spring loaded ball latch 335 retains the removable attachment 343 in one of two use positions, as will be explained below with reference to FIGS. 20 and 21. The removable attachment 343 includes a cavity 346 for receiving the front end of the siding hammer head 344. The removable attachment 343 has a striking face 345 and a depth control face 347. Two radial bores 348*a*, 348*b* are located on opposite sides of the cavity 346. The radial bore 348*a* is aligned with a center of the depth control face 347. The ball latch 335 is supported in a cylindrical cavity 337 in the siding hammer head 344 by a coil spring 339. A threaded hollow nut 341, for example, retains the ball latch 335 in the cylindrical cavity 337. When it is desired to use the siding hammer for nailing siding, the removable attachment 343 is slid over the striking face of the siding hammer head 344 until the ball latch 335 engages one of the radial bores 348*a*, 348*b*, as will be explained below in more detail with reference to FIGS. 20 and 21.

Figure 20:
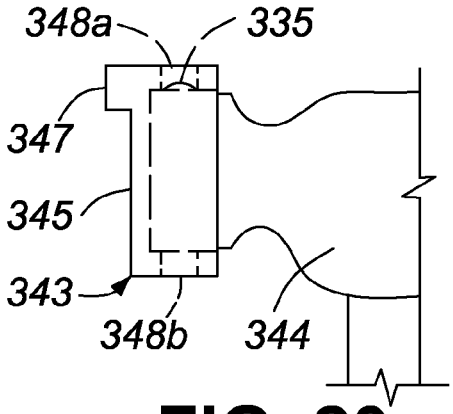
FIG. 20 is a side elevational view of the embodiment shown in FIG. 19 with the removable attachment installed for siding installation while using the siding hammer in a location in which the siding hammer is swung with a head of the siding hammer above a handle of the siding hammer.

FIG. 20 shows the removable attachment 343 attached to the siding hammer head 344 in a position used when the siding hammer is swung with the siding hammer head 344 over a handle of the siding hammer, such as when nailing above waist level, as explained above with reference to FIG. 1. In this position, the ball latch 335 engages the radial bore 348*a* to securely retain the removable attachment 343 in that position. The removable attachment 343 is removed from the siding hammer head 344 by depressing the ball latch with a nail head, or the like, or by rotating the removable attachment 343 manually until the ball latch 335 is disengaged from the radial bore 348*a*.

Figure 21:
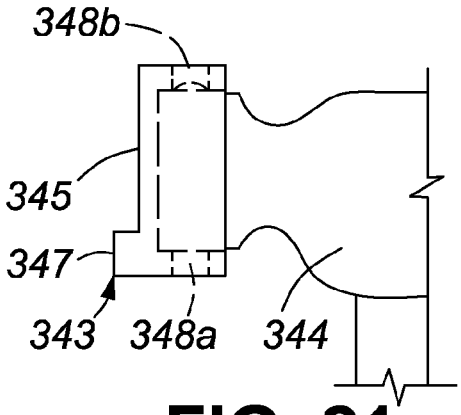
FIG. 21 is a side elevational view of the embodiment shown in FIG. 19 with the removable attachment installed for siding installation while using the siding hammer in a location in which the siding hammer is swung with a head of the siding hammer below a handle of the siding hammer.

FIG. 21 shows the removable attachment 343 attached to the siding hammer head 344 in a position used when the siding hammer is swung with the siding hammer head 344 under the handle of the siding hammer, such as when nailing below waist level, as explained above with reference to FIG. 1. In this position, the ball latch 335 engages the radial bore 348*b* to securely retain the removable attachment 343 in the position in which the depth control face 347 is at a bottom of the siding hammer head 344. As will be understood by those skilled in the art, although the ball latch is shown at a top of the siding hammer head 344, the position of the ball latch 335 is a matter of design choice and it can be located anywhere on the side of the siding hammer head 344 so long as the radial bores 348*a*, 348*b* are correspondingly located to ensure that the depth control face 347 is at a top of the siding hammer head 344 when the ball latch 335 engages one of the radial bores 348*a*, 348*b* and at a bottom of the siding hammer head 344 when the ball latch 335 engages the other of the radial bores 348*a*, 348*b*.

Figure 22:
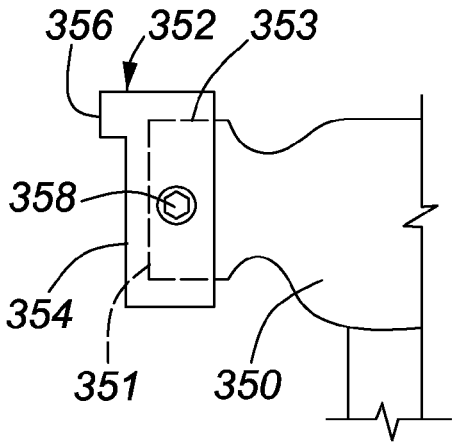
FIG. 22 is a schematic side elevational view of an attachment for converting a hammer to a sliding hammer in accordance with the invention.

FIG. 22 is a schematic side elevational view of an attachment 352 for converting a hammer 350 to a siding hammer in accordance with the invention. The attachment 352 is circular, hexagonal, octagonal, or any other shape required to match a shape of the hammer head 350. The attachment 352 has a cavity 353 that slides over the striking face 351 of the hammer head 350. The attachment 352 has a striking face 354 and a depth control face 356 used for siding applications. In this embodiment, one or more set screws 358 lock the attachment 352 to the hammer head 350.

Figure 23:
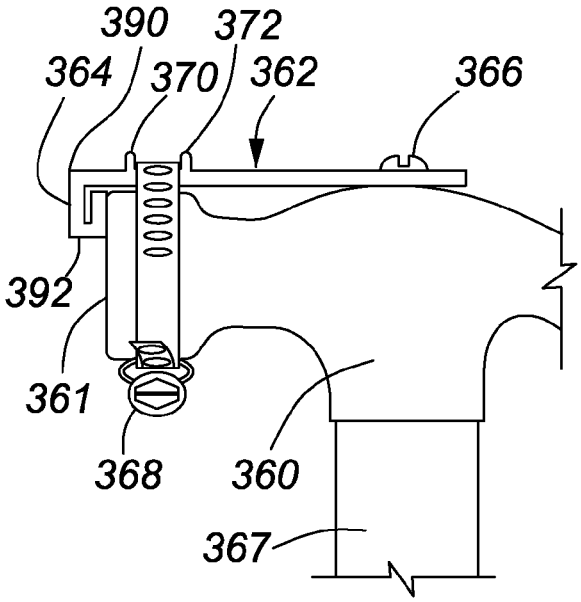
FIG. 23 is a schematic side elevational view of another attachment for converting a hammer to a siding hammer in accordance with the invention.

FIG. 23 is a schematic side elevational view of another attachment 362 for converting a hammer 360 to a siding hammer in accordance with the invention. The attachment 362 includes a depth control face 364 that is offset in front of a striking face 361 of the hammer head 360. The attachment 362 is constructed, for example, from 12 gauge steel sheet metal bent in a U-shape along bend lines 390 and 392 to provide the striking face 364, as will be explained below with reference to FIG. 24. The attachment 362 is secured to the hammer head using a screw 366 driven in to a handle 367 of the hammer 360. The attachment 362 is optionally further secured to the hammer head 360 by a strap 368, for example a hose clamp, as shown, a Velcro® strap, or the like. The strap is held in place by tabs 370 and 372, shown in an unbent plan view in FIG. 24.

Figure 24:
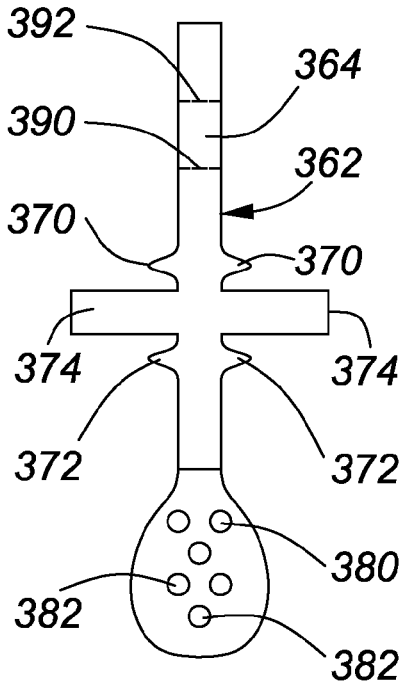
FIG. 24 is a top plan view of the attachment shown in FIG. 20 stamped from sheet steel before the attachment is bent into the configuration shown in FIG. 20.

FIG. 24 is a top plan view of the attachment 362 shown in FIG. 23 after it has been stamped from steel sheet metal and before it is bent into the configuration shown in FIG. 23. The attachment 362 includes the tabs 370, 372 that are bent upward to retain the strap 368. Side wings at 374 are bent downwardly over the hammer head to provide a backing for the strap 368. A plurality of holes 382 are punched in a planar rear end 380 of the attachment 362 to provide a range of choices for the placement of the screw 366 to avoid a steel wedge (not shown) in the hammer handle 367. The attachment 362 is bent 180° at 392 and 90° at 390 to provide the depth control face 364 in front of the striking face 361 as shown in FIG. 23.

Although various embodiments of the invention have been described above, the embodiments illustrated are not considered to be exhaustive of the ways in which the invention can be constructed.

The embodiments of the invention described above are therefore intended to be exemplary only, and the scope of the invention is intended to be limited solely by the scope of the appended claims.

I claim:

1. A siding hammer having a hammer head with a striking face for driving a fastener and a rigid depth control face offset a fixed distance of about 3/16"-1/4" in front of the striking face so that the rigid depth control face impacts a substrate into which the fastener is driven before a head of the fastener contacts a nail hem of siding being supported by the fastener, and the rigid depth control face inhibits further penetration of the fastener into the substrate after the rigid depth control face impacts the substrate, wherein the siding hammer is a dual-faced hammer with a first striking face having the rigid depth control face offset in front of a top of the first striking face, and a second striking face having the rigid depth control face offset in front of a bottom of the second striking face.

2. The siding hammer as claimed in claim 1 wherein the rigid depth control face is an integral part of the hammer head.

3. The siding hammer as claimed in claim 2 wherein the rigid depth control face is a circular ring surrounding the hammer head.

4. The siding hammer as claimed in claim 1 wherein the rigid depth control face is removably attached to the hammer head.

5. The siding hammer as claimed in claim 4 wherein the rigid depth control face comprises a head end of a T-shaped insert received in a bore for supporting the head end of the T-shaped insert the fixed distance in front of the striking face.

6. The siding hammer as claimed in claim 5 wherein the T-shaped insert comprises a rigid plastic insert having a pin end frictionally retained in a bore.

7. The siding hammer as claimed in claim 6 wherein the bore comprises a slot through which an end of the pin end can be accessed when the pin end is received in the bore, to permit the plastic insert to be pried out of the bore.

8. The siding hammer as claimed in claim 1 wherein the depth control face has a square, rectangular, triangular, circular, semicircular, oval, U-shaped or circular segment shape.

9. A siding hammer having a hammer head with a striking face for driving a fastener and a rigid depth control face offset a fixed distance of about 3/16"-1/4" in front of the striking face so that the rigid depth control face impacts a substrate into which the fastener is driven before a head of the fastener contacts a nail hem of siding being supported by the fastener, and the rigid depth control face inhibits further penetration of the fastener into the substrate after the rigid depth control face impacts the substrate, and a hollow handle that houses a hard-to-reach nailing tool, comprising:

a magnetic nail holding end for holding a nail while the nail is being driven, with a rigid depth control face that controls a depth penetration of the nail being driven so that the rigid depth control face impacts a siding nailing hem through an aperture in which the fastener is driven before a head of the fastener contacts the nail hem; and an impact end that is struck by the striking face of the siding hammer to drive the nail held by the nail holding end.

10. A siding hammer having a hammer head with a striking face for driving a fastener and a depth control face offset in front of the striking face that impacts a substrate into which the fastener is driven after a predetermined penetration of the fastener into the substrate, the depth control face inhibiting further penetration of the fastener into the substrate after the depth control face impacts the substrate, wherein the siding hammer is a dual-faced hammer with a first striking face having the depth control face offset in front of a top of the first striking face, and a second striking face having the depth control face offset in front of a bottom of the second striking face.

11. The sliding hammer as claimed in claim 10 wherein the depth control face has a square, rectangular, triangular, circular, semicircular, oval, U-shaped or circular segment shape.

* * * * *